United States Patent [19]

Jones

[11] 3,946,129

[45] Mar. 23, 1976

[54] PREPARATION OF REPROGRAPHIC SHEETS

[75] Inventor: David Vernon Hudson Jones, Sevenoaks, England

[73] Assignee: Coates Brothers & Company Limited, London, England

[22] Filed: June 13, 1973

[21] Appl. No.: 369,531

[30] Foreign Application Priority Data

June 20, 1972 United Kingdom ..... 28890/72

[52] U.S. Cl. ..... 428/304; 96/1.5; 96/1.8; 427/245; 427/378; 428/514

[51] Int. Cl.[2] ..... G03G 5/04; G03G 5/08

[58] Field of Search ..... 117/47 A, 63, 11, 36.7, 117/155; 96/1.5, 1.8; 427/245, 378; 428/304, 514

[56] References Cited

UNITED STATES PATENTS

| | | | |
|---|---|---|---|
| 2,209,940 | 7/1940 | Smith | 117/47 |
| 2,662,033 | 12/1953 | Andrew | 117/47 |
| 2,790,727 | 4/1957 | Hilborn | 117/63 |
| 2,848,752 | 8/1958 | Bechtold | 117/36.7 |
| 3,100,721 | 8/1963 | Holden | 117/63 |
| 3,135,622 | 6/1964 | Ranalli | 117/63 |
| 3,208,875 | 9/1965 | Holden | 117/63 |
| 3,236,717 | 2/1966 | Adhikary | 117/36.7 |
| 3,298,895 | 11/1967 | Plambeck | 117/36.7 |
| 3,347,702 | 10/1967 | Clancy | 117/36.7 |
| 3,384,503 | 5/1968 | Stevenson | 117/36.7 |
| 3,515,567 | 6/1970 | Tani et al. | 117/11 |
| 3,620,806 | 11/1971 | Kohne et al. | 117/36.7 |
| 3,730,667 | 5/1973 | Tani | 117/63 |

*Primary Examiner*—Michael R. Lusignan
*Attorney, Agent, or Firm*—Wigman & Cohen

[57] ABSTRACT

There is disclosed a process of the manufacture of reprographic sheets for use in electrostatography and papers produced thereby. In this method a coating composition is applied to a substrate, generally paper, out of a solution of a mixture of mutually miscible organic liquids, one being a solvent for the polymer and the other a non-solvent for the polymer and removing the organic liquids with most of the solvent being removed before a significant amount of non-solvent is removed.

11 Claims, No Drawings

PREPARATION OF REPROGRAPHIC SHEETS

The present invention relates to a process for the manufacture of papers for use in electrostatography and electrostatographic papers produced thereby. As used herein, the term "electrostatography" is intended to refer to any reprographic process using electrostatics and may conveniently be divided into two main categories, namely electrophotography and electrography.

In electrophotography, electrostatics are used in conjunction with some form of radiation, typically visible or ultraviolet light. One example of an electrophotographic process is the well established process in which an electrostatic charge is applied to the surface of an electrically relatively conducting paper (i.e., having a surface resistivity from about $10^6$ to $10^9$ ohms per square) coated with a dispersion of zinc oxide, or other photoconductive material, in an electrically relatively nonconducting binder (i.e., having a surface resistivity from about $10^{11}$ to $11^{14}$ ohms per square). The charge is then selectively discharged from the surface of the paper by exposing it to light, reflected from or transmitted through the non-printed areas of the item to be copied thereby leaving charged areas on the surface of the paper corresponding to the printed areas on the item to be copied. Finely divided colouring matter is then applied to the surface of the paper and adheres to the charged areas corresponding to the printed areas of the item to be copied. Typically, the finely divided colouring material is applied to the surface of the paper by flooding the surface with a dispersion of the colouring material in an inert liquid. The image is then fixed is then fixed in place by some suitable means, typically by heating. Such a process depends on the initial application of an overall electrostatic charge to the paper and its subsequent selective discharge due to the photoconductive properties of the zinc oxide dispersion. Other photoconductive materials which may be used in place of the zinc oxide coating include organic photoconductive materials.

In electrography, electrostatics are used without radiation. An example of an electrographic process is the so called "dielectric-printing" process in which a charged pattern is applied to the surface of an electrically relatively conducting paper coated with a layer of a relatively non-conducting polymer. The patterned charged paper is then treated with finely divided colouring material in a similar manner as described above for the electrophotographic process and fixed so that it adheres to the patterned charge and is then fixed thereon in a similar manner to that described above. The charged pattern may be applied, for example, from the points of a matrix of pins selectively actuated by the output of a computer.

Papers for electrophotographic process are generally prepared by coating an electrically relatively conducting paper with a composition comprising a dispersion of zinc oxide or other photoconductive material in a solution of one or more substantially non-conducting polymers. This dispersion is applied to the paper by means of conventional papercoating machines and the solvent is allowed to evaporate (optionally with the assistance of heat and/or a current of air) to form a layer of the polymer containing the photoconductive material on the surface of the paper. Papers for electrographic processes are generally prepared in a similar manner except that the composition with which the paper is coated contains no photoconductive material, that is the coating applied to the paper comprises a layer formed of one or more substantially non-conducting polymers. Typical dry film weights of known coatings are:

| | |
|---|---|
| zinc oxide coating | 25 – 35 gms/sq. meter |
| dielectric (polymer) coating | 3 – 9 gms/sq. meter |

In general it may be said that, within practical limits, the greater the film weight, the better the performance of the paper in an electrostatographic process. Increased film weight, however, naturally leads to an increase in cost and, particularly in the case of the dense zinc oxide coatings, leads to the production of papers which are unacceptably heavy and have an unacceptable handle.

One method of forming electrographic papers is illustrated by U.S. Pat. No. 3,399,060. In this patent the coating composition is applied from an aqueous system or emulsion, either water in oil or oil in water. On drying, the coating layer contains voids which the patentee alleges results in a photosensitive coating more responsive to light exposure than an equal conventional coating of the same polymer and photoconductive particles which contains no voids. The two component system thereof, one of which is water, however, while providing a lighter weight coating through the voids, possesses disadvantages in that the resulting copy does not meet the standards of conventional copy papers.

British Pat. No. 1,178,612 does not deal with the preparation of electrographic papers. The patent, however, does relate to coating of substrates resulting in films which are microporous to provide an opaque film without the necessity of pigments conventionally used to provide opaque films. This process uses a solution of the film forming polymer which solution comprises at least two miscible liquids, at least one of which is a non-solvent for the polymer and has a lower volatility than the other liquid in the mixture. On evaporation the low-volatility non-solvent leaves microscopic voids in the structure which cause light scattering and opacity, such as to provide a Kubelka-Munk scattering coefficient greater than 0.5 reciprocal mils at 4400 angstroms and greater than 0.1 reciprocal mils at 5600 angstroms. The patent points that substantially all the voids or cells are less than 1 micron and preferably less than 0.5 microns in size. With many of the films essentially none of the cells are larger than 0.1 microns.

It has now been found, in accordance with the present invention, that the performance of a coating in an electrographic paper, at a given film weight, may be increased simply by incorporating in the coating composition applied to the paper a relatively involatile liquid which is a non-solvent for at least one of the polymer components of the composition. Thus, it has been found in accordance with the invention, that coating film weights may be substantially reduced without loss of reprographic performance or, alternatively, it is possible to produce papers which, at a given film weight, give improved print density as compared with conventionally coated papers.

According to the invention, therefore, there is provided a process for the preparation of a reprographic sheet for use in an electrostatographic process by coating the surface of an electrically relatively conducting substrate with a coating composition comprising a solution of one or more electrically relatively non-conducting polymers in a solvent therefor and subsequently allowing the coating to dry, in which the coating composition slao contains a relatively involatile liquid which is a non-solvent for at least one of the polymer components of the solution. The substrate used in the process of the invention will most commonly be a paper but it will be understood that other substrates may be employed such a white lined board, provided they have the required electrical characteristics. In the following description, for the sake of convenience, reference will be made only to the use of paper as a substrate but it will, of course, be understood that the discussion is applicable to the use of other substrates.

A variety of relatively non-conducting polymers may be used in the coating compositions employed in the process of the invention, including, for example vinyl modified alkyd resins, silicone modified alkyd resins and vinyl or vinylidene polymers and copolymers. It has been found that polymers and copolymers of vinyl acetate and and styrene are especially useful in the practice of the process of the invention. The preferred styrene copolymers are those of styrene and ethyl acrylate wherein either monomer is present in the copolymer in an amount of 35–65% by weight. The preferred vinyl acetate copolymers are those using the alkyl acrylates such as n-butyl acrylate as the comonomer wherein the vinyl acetate comprises 80–95%, and preferably about 90% by weight of the copolymer. The polymers or copolymers may contain functional groups such as hydroxyl or carboxyl groups in order to improve the wetting or adhesion properties of the polymer.

The coating compositions used in the process of the invention contain a solvent for the polymer and this solvent may comprise a single compound or a mixture of solvents. The solvent must dissolve all the polymer components of the coating composition and should be sufficiently volatile to evaporate from the coated paper at an acceptable rate having regard to the speed of the coating machine and the drying conditions employed. Suitable solvents include, for example, toluene, ethanol, isopropanol, methyl ethyl ketone and ethyl acetate or mixtures thereof. The non-solvent liquid added to the coating composition in accordance with the present invention may also comprise one or more compounds and must be appreciably less volatile than the solvent, suitably, for example, having a boiling point from about 40°C. to about 80°C. above that of the solvent, the upper limit being determined by the drying conditions employed in the coating process. It has been found that the best results are obtained in accordance with the invention when the solvent-nonsolvent combination is such that most of the solvent evaporates from the coating before significant loss of non-solvent occurs, i.e. such that the bulk of the non-solvent evaporates towards the end of the drying process. Preferred non-solvents, in view of their low cost and general suitability to most of the polymers employed, are the relatively high boiling (about 300°–400°F.), nonpolar, aliphatic hydrocarbons, high in paraffins ($^{C}10$ or longer), Illustrative of those consisting substantially of paraffinic hydrocarbons are white spirit, odourless white spirit and a commercially available product "Isopar G" believed to be composed largely of isododecane (about 93% paraffinic hydrocarbon and about 7% naphthenes). Another suitable commercial product is AMSCO's Naphthol Spirits 66/3, which is lower in paraffin content and higher in naphthene content that Isopar G, i.e. about 50% of each.

However, other non-solvents may be used and thus, for example, commercial trimethyl benzene is a suitable non-solvent for use in conjunction with many styrene, vinyl acetate and acrylic copolymers for which it is a non-solvent although it is unsuitable for use with conventional vinyl modified alkyd resins on account of its relatively high solvent power for such polymers.

Where the reprographic sheet produced in accordance with the invention is intended for use in an electrographic process, the coating composition will, of course, not contain any zinc oxide or other photoconductive material but the composition will contain such photoconductive material when the reprographic sheet is intended for use in an electrophotographic process. The photoconductive properties of zinc oxide are commonly enhanced by incorporating certain dyestuffs into the coating composition and, in such cases, the coating composition used in the process of the invention is preferably formed by dispersing the zinc oxide and dyestuff(s) in all or part of the solvent before adding to the polymer thereto, preferably as a concentrated solution. The non-solvent may be incorporated at any stage of this process.

The concentration of the polymer in the solution is determined by considerations well known in the art, i.e. 50–60% solids by weight, as are the amounts and quantities of the zinc oxide and dyestuffs when such are employed, i.e. zinc oxide to polymer ratios of 4–8 and 100–250 ppm based on zinc oxide of dyestuff.

The quantity of non-solvents present in the coating composition should be less than that amount which causes precipitation of the polymer from the solution at the concentration chosen for application. This limit is readily determined by titration of the polymer solution with the non-solvent to the point at which the first signs of permanent cloudiness are observed. Further, the quantity of non-solvent in the composition should be such that the quotient (volume of non-solvent) / (volume of non-solvent plus volume of polymer) has a value of from 0.35 to 0.65. Thus it has been found that for a value of the above quotient below 0.35, the advantages of the use of the non-solvent are not appreciably shown whereas for values above about 0.65, the dried film tends to be friable.

In order that the invention may be well understood, the following Examples are given by way of illustration only. In the Examples all parts and percentages are by weight unless otherwise stated. In the Examples the saturation potential and light decay rates of the coating were measured at 55% R.H. on a Dyntest 90 machine (manufactured by E.C.E. G. mbh of Giessenr Germany) measured at 55% R.H.

EXAMPLE 1

The polymer used in this Example was Synolac 607S (a nominally 60% solution in toluene of a styrene copolymer) (about 40% styrene and 60% ethyl acrylate), marketed by Cray Valley Products Limited.

Synolac 607S (50 parts), electrophotographic grade zinc oxide (180 parts), and toluene (121 parts) were mixed together and ball-milled to a Hegman gauge ("fineness of grind") reading of 5. The resultant dispersion had a total solids (zinc oxide + polymer) content of 59.8% and a vehicle solids content (concentration of polymer in the binder solution) of 17.5%. The pigment: binder ratio was 6:1.

To this dispersion were added the following dyestuffs at the levels stated, addition being in the form of 1% ethanolic solution and followed by thorough stirring:

Bromophenol blue (BPB) — 50 parts per million calculated on the weight of zinc oxide Uranine (C.I 45350) — 100 parts per million calculated on the weight of zinc oxide.

Methylene blue — 25 parts per million calculated on (C.I 52015) — the weight of zinc oxide Part of the dispersion (Example 1A) was thinned with toluene to a vehicle solids content of 15%, for use as a control in accordance with the prior art.

Part of the dispersion (Example 1B) was thinned with Isopar G to a vehicle solids content of 15%. The liquid phase of this solution contained 70% toluene, 15% polymer and 15% Isopar G. The density of the solid polymer present in the Synolac 607S solution was found to be 1.05 grams per cubic centimeter; the density of Isopar G was found to be 0.75 grams per cubic centimeter so that the quotient (volume of non-solvent + volume of polymer) had the value of 0.58. The boiling point of toluene is 111°C.; Isopar G has a boiling range of 160° to 174°C. Taking the mid-point of the Isopar G boiling range, the difference in boiling point between toluene and Isopar G is 56°C.

The thinned dispersions of Examples 1A and 1B were each applied by hand using a wire-wound bar coater to a commercial conductive basepaper and dried in a current of warm air. The coated papers were stored in the dark at 70°F. and 55% relative humidity for 16 hours and were then compared for electrophotographic performance using an SCM 44 copying machine and a standard test print.

The paper coated with the composition 1A gave a clean background at an exposure setting one stop lower than the paper coated with the composition 1B, i.e. it was marginally faster in use. However, prints on the paper coated with composition 1A were less dense than those on paper coated with composition 1B and where not acceptable by commercial standards. Printes on the paper coated with composition 1B were of good quality, having clean backgrounds and high print density. Both coatings 1A and 1B were applied at a rate of 22 grams per square meter. With regard to electrical properties 1A had a saturation potential of 370 volts and light decay rate of 37 volts/second while 1B has a saturation potential of 480 volts and a light decay rate of 22 volts/second.

EXAMPLE 2

A dye solution was prepared consisting of Bromophenol blue (0.75g) and Eosin (C.I. 45386) (0.25g) in industrial ethanol (100 ml).

Coating composition 2A was prepared by ball-milling for 4 hours a mixture of toluene (960 g), Isopar G (240 g), electrophotographic grade zinc oxide (800 g) and the above dye solution (27 ml) after which Synolac 607S (500 g) was added and ball-milling continued to a Hegman gauge reading of 5 – 6.

Coating composition 2B was prepared in a single stage by ball milling to a Hegman gauge reading of 5 – 6, toluene (1200 g), electrophotographic grade zinc oxide (800g) dye solution (27 ml) and Synolac 607S (500 g).

These compositions were each applied to conductive base paper by means of a pilot plant coater employing a reverse roll system. The coated papers were dried by passage through a hot-air chamber maintained at 90°C. The coating machine was adjusted to give dry film weights of 22 grams per square meter using composition 2B. Coating 2A had a saturation potential of 560 volts and a light decay rate of 51 volts/second while 2B had a saturation potential of 640 volts and a light decay rate of 53 volts/second.

When tested on the S.C.M. 44 copying machine, both papers required the same minimum exposure setting to give a clean backgroung, at which setting the densities of the prints were indistinguishable, despite the lower film weight of composition 2A.

EXAMPLE 3

A dispersion was prepared by ball-milling the following ingredients to a Hegman gauge reading of 5 – 6:

34 grams of Synolac 608S (a 50% solution in toluene of a vinyl acetate (about 90%) and n-butyl acrylate copolymer, respectively about 90:10 ratio)

23 grams of Synolac 609S (a 60% solution in toluene of a styrene and ethyl acrylate copolymer, respectively about a 40:60 ratio)

110 grams of toluene 180 grams of zinc oxide, electrophotographic grade.

The total solids content of this dispersion was 60% and the vehicle solids 17.7%.

Coating compositions 3A and 3B were prepared by adding to 50 gram portions of the above dispersion 4.2 grams toluene and 4.2 grams commercial trimethyl benzene respectively, followed in each case by a dyestuff mixture in 1% ethanolic solution to give the following dyestuff concentration calculated on the zinc oxide.

| | |
|---|---|
| Bromophenol blue | 50 ppm. |
| Uranine | 100 ppm. |

Both coating were each applied to a commercial conductive paper by means of a bar coater and dried in a stream of warm air to give dry film weights of 25 grams per square meter.

When tested on the S.C.M. 44 copier, the papers coated with composition 3B gave prints which were substantially denser at the same machine setting. The saturation potential of 3A was 470 volts while 3B had a saturation potential of 530 volts.

EXAMPLE 4

Two electrographic coating compositions were prepared by ball-milling the following ingredients for 3 hours to a Hegman gauge reading of 8+:

| | 4A | 4B |
|---|---|---|
| Synolac 620S | 215 grams | 215 grams |
| Syloid 165 | 20 grams | 20 grams |
| Toluene | 150 grams | 200 grams |
| Industrial ethanol | 65 grams | 65 grams |
| Isopar G | 50 grams | — |

Synolac 620S is a 60% solution of a styrene and ethyl acrylate copolymer, respectively about a 60:40 ratio. Syloid 165 is a micronized silica marketed by W. R. Grace Limited. Its inclusion is merely to give a preferred mat finish to the coating — it is not essential to the working of the example.

Both dispersions were each applied to a commercial conductive base-paper by means of a bar coater and dried in a current of warm air to give dry film weights: (4A) 3.9 grams per square meter, (4B) 4.2 grams per square meter. When the papers were tested on an electrographic facsimile printer (marketed by Syntron), the prints on the paper coated with composition 4A were greatly superior in density and contrast. The saturation potential of 4A was 200 volts while 4B had a saturation potential of 100 volts.

EXAMPLE 5

The Kubelka-Munk scattering coefficients as defined in British Pat. No. 1,178,612 were determined on the results obtained with the 608S and 609S solutions incorporating nonsolvent. The results were as follows:

| Wavelength (nm) | Scatter coefficient (reciprocal mils) 608S | 609S |
|---|---|---|
| 400 | $8 \times 10^{-4}$ | $5 \times 10^{-3}$ |
| 440 | $8 \times 10^{-4}$ | $5 \times 10^{-3}$ |
| 500 | $8 \times 10^{-4}$ | $4 \times 10^{-3}$ |
| 560 | $7 \times 10^{-4}$ | $4 \times 10^{-3}$ |
| 580 | $7 \times 10^{-4}$ | $4 \times 10^{-3}$ |

EXAMPLE 6

This example serves to compare copy quality of the process and product of U.S. Pat. No. 3,399,060 with that of the present ivention. In this work, examples 2, 3 and 4 of U.S. Pat. No. 3,399,060 were duplicated using the materials as follows:

Example (2): Polyvinyl alcohol (DuPont type A grade RH-403), zinc oxide (Photox 80-New Jersey Zinc), distilled water, ammonium oleate and kerosene. This represents an oil-in-water emulsion.

Example (3): Ethyl cellulose (Hercules K type 45 cps), zinc oxide (Pnotox 80), benzene, Triton X-405 surfactant (Rohm & Haas), distilled water and 10 drops of 1% dye sensitizer (3:1 BPB/EOSINE). This is a water in oil emulsion.

Example (4) Acid casein, 28% $NH_3$, zinc oxide (Photox 80), distilled water, uranine dye sensitizer and kerosene. Represents oil-in-water.

Dispersion and preparation of these samples was done as indicated in the patent except that 10 drops of 1% dye solution was also added to Example (2). For comparison a coating was prepared following Example 3 above except that the polymer was solely the 609 product (no 608) and the zinc oxide was Photox 80. Papers were prepared on Weyerhaeuser base paper "M", an electroconductive base paper, and run on an APECO copier. Examples (2) and (4) of the U.S. patent would not provide a print on the copier. Example (3) of the U.S. patent through providing a print which was legible, but of poor quality, was not acceptable by commercial standards. In contrast the product of this invention provided an acceptable print.

EXAMPLE 7

In view of U.S. Pat. No. 3,399,060, four coatings were prepared and void sizes studied. The four coatings were (a) Example 3 of U.S. Pat. No. 3,399,060 as in Example 6 above but without dye sensitizer, (b) a conventional film coating with the 609 product without any non-solvent and (c) a coating using the AMSCO Naphthol Spirits 66/3 non-solvent at an 8.5% non-solvent and (d) a repeat of (c) at a 15.0% non-solvent level. The formulation of coatings (b), (c), and (d) were as follows:

| | (b) | (c) | (d) |
|---|---|---|---|
| Zinc Oxide (Fotofax 661) | 50 | 50 | 50 |
| Styrene-ethyl acrylate copolymer (609) | 12 | 12 | 12 |
| Naphthol Spirits 66/3 | — | 4.6 | 8.1 |
| Toluene | 42 | 37.4 | 33.9 |
| % Non-solvent (on total vehicle) | none | 8.5 | 15.0 |

These coatings were prepared by dispersion in glass jars. Drawdowns were made on Weyerhauser "J" base paper and on teflon coated fabric with 3.0 mil and 1.5 mil wet bar, No. 12, No. 20 and No. 40 Meyer rods. Void size was determined on the Scanning Electron Microscope on surface pictures and cross section views of free films.

Coating (a) showed definite voids in the cross-sectional area, however, the majority of these appeared to be in the 1.3–1.7 micron area. Coatings (b) – (d) showed similar appearances and void sizes. Continuous micro-pores appear in the coating rather than discrete closed cells. Measurements indicated that the majority of the voids were in the 0.7–1.5 micron range with a very small percentage above this.

As can be seen from the foregoing, improved quality reprographic sheets may be produced by applying to the substrate a composition of a film forming polymer in a solvent mixture for the polymer, the solvent mixture comprising at least two mutually miscible organic liquids, at least one of which is a solvent for the polymer and at least one of which is a non-solvent for the polymer. The non-solvent has a lower volatility and upon removal of the liquid mixture most of the liquid which is a solvent for the polymer is removed before a significant portion of the non-solvent is removed. The coating composition may contain a photoconductive pigment such as zinc oxide. The resulting reprographic sheet, which is suitable for electrographic reproduction, comprises a substrate and a photoconductive film thereon which was applied as described above. The resulting film is such that it will have a maximum Kubela-Munk scattering coefficient of $5 \times 10^{-2}$ reciprocal mils at 440 and 500 nm wavelength respectively. Micro porous voids are found in the film with sizes greater than 1 micron and less than 2 microns, resulting from the use of the lower volatility non-solvent in the method of application of the film forming polymer.

I claim:

1. A process for preparing a reprographic sheet suitable for electrostatographic reproduction comprising (a) providing an electrically relatively conducting substrate, (b) applying to said electrically relatively conducting substrate a composition comprising a film forming material of an electrically relatively non-conducting polymer and an organic liquid mixture comprising at least one solvent for said film forming material and at least one non-solvent for said film forming material, said non-solvent being miscible with and having a lower volatility than that of the other liquids in said mixture, said non-solvent being present in an amount less than that which causes precipitation of the film forming material from the organic liquid mixture, the volume of non-solvent to the volume of non-solvent plus volume of polymer being from 0.35 to 0.65, and (c) removing said organic liquid mixture from said composition applied to said substrate such that substantially all of said solvent for said film forming material is removed before any significant portion of said non-solvent is removed, thereby forming a sheet of said substrate carrying said film forming material, said sheet being a reprographic sheet which possesses the necessary electrical characteristics for use in electrostatographic reproduction.

2. A process as defined in claim 1 wherein said non-solvent has a boiling point from about 40–80°C. above the boiling point of said solvent.

3. A process as defined in claim 1 wherein said non-solvent is a non-polar aliphatic hydrocarbon having at least 10 carbon atoms and a boiling point of about 300°–400°F.

4. A process as defined in claim 1 wherein said non-solvent is a hydrocarbon mixture having a boiling point of about 300°–400°F. and having a paraffin hydrocarbon content of at least about 50% by weight of said mixture, said paraffin hydrocarbon containing at least 10 carbon atoms.

5. A process as defined in claim 1 wherein said non-solvent is isododecane.

6. A process as defined in claim 1 wherein said film forming material is selected from the group consisting of a styrene polymer and a vinyl acetate polymer.

7. A process as defined in claim 6 wherein said styrene polymer is a copolymer of styrene and ethyl acrylate wherein the styrene content of said copolymer is about 35–65% by weight of said copolymer.

8. A process as defined in claim 6 wherein said vinyl acetate polymer is a copolymer of vinyl acetate and n-butyl acrylate wherein said vinyl acetate content of said copolymer is about 80–95% by weight of said copolymer.

9. The process of claim 1 wherein the composition further includes a photoconductor.

10. The process of claim 9 wherein the photoconductor is zinc oxide.

11. A reprographic sheet prepared in accordance with claim 1 wherein said film forming material carried on said substrate upon removal of said solvent and non-solvent provide a film having a maximum Kubelka-Munk scattering coefficient of $5 \times 10^{-2}$ reciprocal mils at 4400 and 5600 angstroms and micro porous voids greater than one micron and less than 2 microns.

* * * * *